US010344386B2

(12) United States Patent
Kodama et al.

(10) Patent No.: US 10,344,386 B2
(45) Date of Patent: Jul. 9, 2019

(54) ELASTIC CUSHION MATERIAL AND ION EXCHANGE MEMBRANE ELECTROLYTIC CELL UTILIZING SAME

(71) Applicant: thyssenkrupp Uhde Chlorine Engineers (Japan) Ltd., Tokyo (JP)

(72) Inventors: Yoshiyuki Kodama, Tamano (JP); Koji Kawanishi, Tamano (JP)

(73) Assignee: thyssenkrupp Uhde Chlorine Engineers (Japan) Ltd., Tokyo (JP)

( * ) Notice: Subject to any disclaimer, the term of this patent is extended or adjusted under 35 U.S.C. 154(b) by 33 days.

(21) Appl. No.: 14/407,394

(22) PCT Filed: May 30, 2013

(86) PCT No.: PCT/JP2013/065085
§ 371 (c)(1),
(2) Date: Dec. 11, 2014

(87) PCT Pub. No.: WO2013/187242
PCT Pub. Date: Dec. 19, 2013

(65) Prior Publication Data

US 2015/0122641 A1 May 7, 2015

(30) Foreign Application Priority Data

Jun. 13, 2012 (JP) ..... 2012-134271

(51) Int. Cl.
*C25B 9/02* (2006.01)
*C25B 15/04* (2006.01)
(Continued)

(52) U.S. Cl.
CPC ..... *C25B 9/02* (2013.01); *C25B 9/066* (2013.01); *C25B 9/08* (2013.01); *C25B 15/04* (2013.01)

(58) Field of Classification Search
CPC ..... C25B 1/00; C25B 1/24–265; C25B 1/34; C25B 1/46; C25B 9/00; C25B 9/02;
(Continued)

(56) References Cited

U.S. PATENT DOCUMENTS 2,967,814 A * 1/1961 Tuwiner ..... C25C 7/02 204/284
5,231,709 A * 8/1993 Miller ..... A47C 7/32 5/13
(Continued)

FOREIGN PATENT DOCUMENTS

CN 1451786 A 10/2003
CN 1537973 A 10/2004
(Continued)

OTHER PUBLICATIONS

Chinese Office Action and Search Report, dated May 24, 2016, for Chinese Application No. 201380031146.6.
(Continued)

*Primary Examiner* — Alexander W Keeling
(74) *Attorney, Agent, or Firm* — Birch, Stewart, Kolasch & Birch, LLP

(57) ABSTRACT

Provided are an elastic cushion member and an ion exchange membrane electrolyzer using the same, which elastic cushion member can be installed even in an ion exchange membrane electrolyzer having such a small gap between an electrode and an electrode current collecting plate that a conventional elastic cushion member cannot be arranged therein. An elastic cushion member (10) has a pair of corrosion-resistant metal thin plates (11) arranged at a distance in parallel fashion and a fixing member (12) which fixes the pair of corrosion-resistant metal thin plates (11) and comprises a metal elastic body (13) wound between the pair of corrosion-resistant metal thin plates (11). The fixing member (12) is attached to the pair of corrosion-resistant
(Continued)

metal thin plates (11) in a manner that enables detachment of the fixing member therefrom. The metal elastic body (13) is preferred to be a metal coil body. It is also preferable that each of the corrosion-resistant metal thin plates (11) is provided with a slippage prevention means.

7 Claims, 2 Drawing Sheets

(51) Int. Cl.
*C25B 9/08* (2006.01)
*C25B 9/06* (2006.01)

(58) Field of Classification Search
CPC .. C25B 9/06; C25B 9/066; C25B 9/08; C25B 9/12; C25B 15/00; C25B 15/04; H01M 2/14–185; H01M 2/10–1094
See application file for complete search history.

(56) References Cited

U.S. PATENT DOCUMENTS

2003/0188966 A1 10/2003 Katayama
2004/0088245 A1 5/2004 Narayan et al.
2004/0188245 A1 9/2004 Katayama et al.
2012/0125782 A1 5/2012 Asaumi et al.
2012/0235382 A1* 9/2012 Elrod ..... B60D 1/50 280/483
2012/0241314 A1* 9/2012 Madono ..... C25B 11/035 204/252

FOREIGN PATENT DOCUMENTS

CN 102459708 A 5/2012
EP 1464728 A1 10/2004
JP 58-133386 A 8/1983
JP S63-053272 A 3/1988
JP 2003-313690 A 11/2003
JP 2004-300543 A 10/2004
JP 2004-300547 A 10/2004
JP 2004-300554 A 10/2004
JP 2011-117047 A 6/2011
JP 2012-57199 A 3/2012
WO WO 2012/032793 A1 3/2012

OTHER PUBLICATIONS

International Search Report issued on PCT/JP2013/065085 dated Jul. 23, 2013.
Extended European Search Report, dated Dec. 22, 2015, for European Application No. 13804146.2.

* cited by examiner

[Fig. 1]
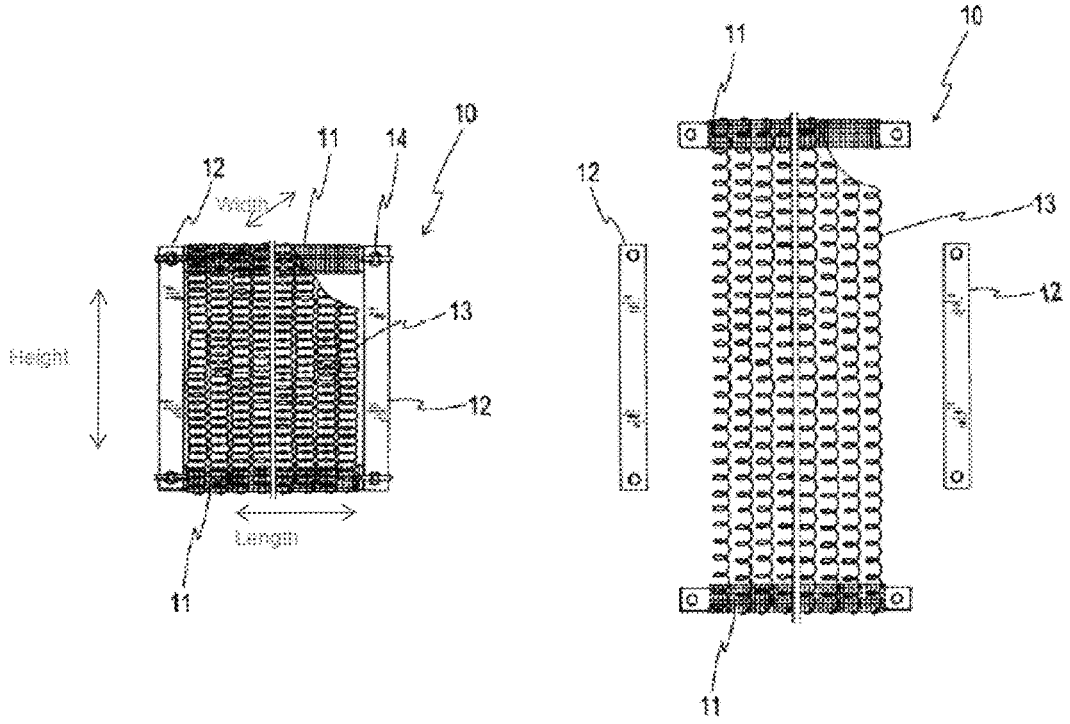
[Fig. 2]
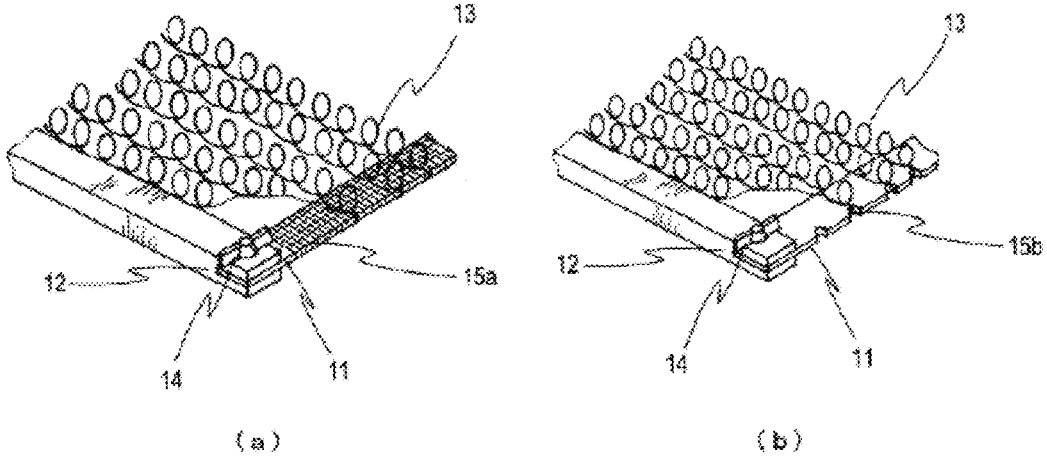

[Fig. 3]
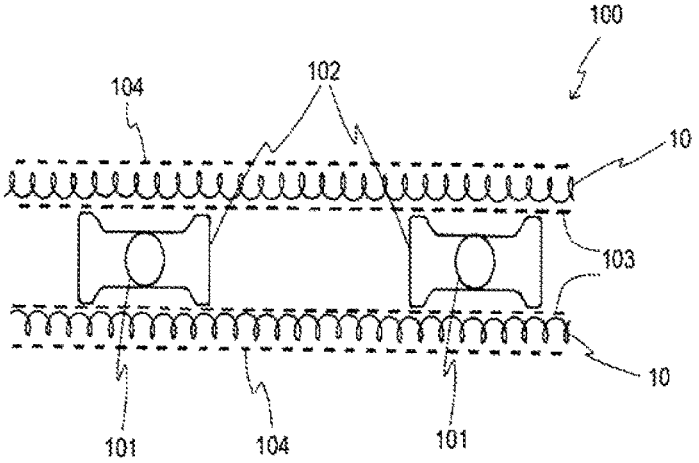
[Fig. 4]
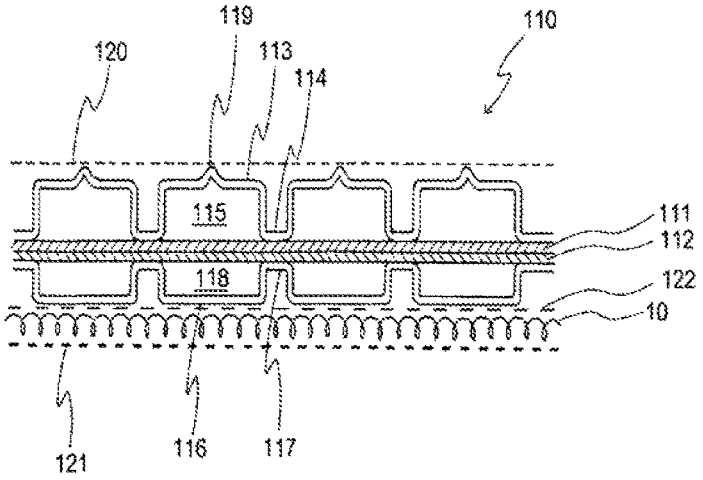
[Fig. 5]
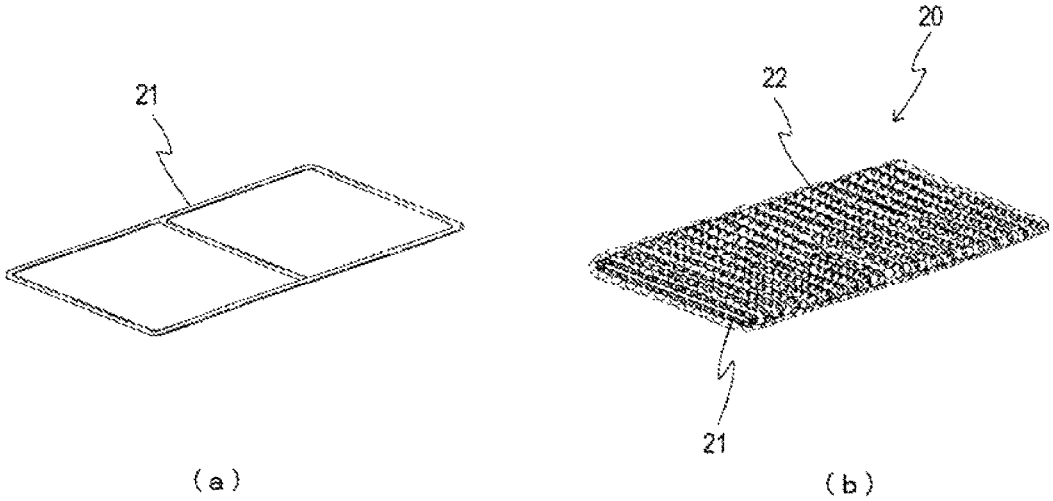

ELASTIC CUSHION MATERIAL AND ION EXCHANGE MEMBRANE ELECTROLYTIC CELL UTILIZING SAME

TECHNICAL FIELD

The present invention relates to an elastic cushion member and an ion exchange membrane electrolyzer (hereinafter also simply referred to as "electrolyzer") using the same, particularly to an elastic cushion member elastic cushion member and an ion exchange membrane electrolyzer using the same, which elastic cushion member can be installed even in an ion exchange membrane electrolyzer having such a small gap between an electrode and an electrode current collecting plate that a conventional elastic cushion member cannot be arranged therein.

BACKGROUND ART

In an ion exchange membrane electrolyzer used for chlorine-alkaline electrolysis, three components of the ion exchange membrane electrolyzer, which are an anode, an ion exchange membrane and a hydrogen-generating cathode, are normally arranged in close contact with each other to promote reduction in electrolysis voltage. However, in a large-scale electrolyzer which attains as much as several square meters of electrolysis area, when an anode and a cathode made of a rigid member were accommodated in the electrolyzer, it was difficult to maintain the distance between the electrodes at a determined value, with both electrodes brought into close contact with an ion exchange membrane.

An electrolyzer is known in which an elastic material is employed on an item used as a means to reduce the distance between electrodes or between an electrode and a current collector or as a means to maintain the distance between them at a nearly constant value. Such an electrolyzer has a structure in which at least one of the electrodes moves freely in the direction from one electrode to the other in order to avoid breakage of an ion exchange membrane by uniformly close contact of the electrode with the ion exchange membrane and to maintain the minimum distance between the anode and the cathode, and the pinch pressure is controlled by pressing the electrode through the elastic member. Non-rigid materials such as woven fabric, non-woven fabric, mesh and the like, which are formed of a metal fine wire; and rigid materials such as leaf spring and the like are known as examples of this elastic material.

However, conventional non-rigid materials had disadvantages. For example, when excessive pressure is applied to a conventional non-rigid material from the anode side after attaching it to an electrolyzer, the non-rigid material is partially deformed to have a non-uniform distance between electrodes and/or an ion exchange membrane is pricked with a fine wire of the non-rigid material. Moreover, rigid materials such as leaf spring and the like had disadvantages. For example, a rigid material damages an ion exchange membrane and/or causes plastic deformation of an ion exchange membrane so that the ion exchange membrane cannot be reused. Furthermore, for an ion exchange membrane electrolyzer such as a brine electrolyzer, the close proximity of an anode and/or a cathode to an ion exchange membrane is preferred to allow continuous operation of the electrolyzer at a low voltage and therefore various methods to press an electrode toward an ion exchange membrane are proposed.

For example, Patent Document 1 proposes an electrolyzer in which a metal coil body instead of a conventionally used leaf spring or metal mesh body is installed between a cathode and a cathode end plate and the cathode is uniformly pressed toward a barrier membrane to bring each member into close contact with the barrier membrane. However, a metal coil body has a high deformation ratio and therefore is difficult to handle and often causes difficulty in installation to a determined part of an electrolyzer in accordance with a worker's intention. Moreover, a metal coil body is easily deformed (its strength is insufficient) and it sometimes causes difficulty in uniformly close contact between respective members due to deviation of the metal coil body by an electrolyte and/or generated gas in an electrolyzer even if the metal coil body is once installed to a determined part of the electrolyzer.

In order to address such an issue, Patent Document 2 proposes an ion exchange membrane electrolyzer, in which an elastic cushion member (20) instead of a metal coil body is installed between a hydrogen-generating cathode and a cathode current collecting plate and the hydrogen-generating cathode is uniformly pressed toward an ion exchange membrane, wherein this elastic cushion member (20) is prepared as shown in FIG. 5*b* by winding a metal coil body (22) around a rectangular corrosion-resistant frame (21) as shown in FIG. 5*a* so as to provide a nearly uniform density.

RELATED ART DOCUMENTS

Patent Documents

Patent Document 1: Japanese Unexamined Patent Application Publication No. S 63-53272
Patent Document 2: Japanese Unexamined Patent Application Publication No. 2004-300543

SUMMARY OF THE INVENTION

Problems to be Solved by the Invention

An elastic cushion member (20) described in Patent Document 2 has advantages that the elastic cushion member is easy to handle because a corrosion-resistant frame (21) and a metal coil body (22) as a metal elastic body are integrated as an elastic cushion member, and, moreover, the elastic cushion member also has no possibility of deformation and therefore it can always produce a constant amount of pressing pressure. However, because this elastic cushion member (20) is prepared by winding a metal coil body (22) around a corrosion-resistant frame (21), the corrosion-resistant frame (21) requires strength above a certain level, which allows the corrosion-resistant frame to resist a tensile force exerted by the metal coil body (22). Thus, a round metal bar of about 1.2-1.6 mm in diameter and the like are usually used as a material of the corrosion-resistant frame (21). Therefore, the elastic cushion member (20) cannot be used in an electrolyzer having an extremely small distance (gap) between an electrode and an electrode current collecting plate, which distance is as small as 1 mm or less.

Accordingly, the object of the present invention is to provide an elastic cushion member and an ion exchange membrane electrolyzer using the same, which elastic cushion member can be installed even in an ion exchange membrane electrolyzer having such a small gap between an electrode and an electrode current collecting plate that a conventional elastic cushion member cannot be arranged therein.

Means for Solving the Problems

The inventors have studied intensively to resolve the above-described problems and eventually found that an elastic cushion member thinner than a conventional one was able to be prepared while unnecessary materials were eliminated not by producing a corrosion-resistant frame as a single integral item but by producing various components individually and assembling them, and thereby completed the present invention.

That is, an elastic cushion member of the present invention is an elastic cushion member having a pair of corrosion-resistant metal thin plates arranged at a distance in parallel fashion and a fixing member which fixes the pair of corrosion-resistant metal thin plates, wherein a metal elastic body is wound between the pair of corrosion-resistant metal thin plates, and the fixing member is detachably attached to the pair of corrosion-resistant metal thin plates.

In the elastic cushion member of the present invention, a slippage prevention means is preferably provided to the corrosion-resistant metal thin plates. Moreover, in the elastic cushion member of the present invention, the metal elastic body is preferably a metal coil body.

Moreover, an ion exchange membrane electrolyzer of the present invention is an ion exchange membrane electrolyzer separated by an ion exchange membrane into an anode chamber accommodating an anode and a cathode chamber accommodating a cathode, wherein an elastic cushion member is arranged in at least one of the anode chamber and the cathode chamber, characterized in that the elastic cushion member is the above-described elastic cushion member of the present invention.

In the ion exchange membrane electrolyzer of the present invention, the elastic cushion member may be arranged at least one of: between the cathode and a cathode current collector and between the anode and an anode current collector, wherein the electrodes are in close contact with the ion exchange membrane by the counterforce of the metal elastic body, or the elastic cushion member may be arranged at least one of: between the cathode and a cathode partition wall and between the anode and an anode partition wall, wherein the electrodes are in close contact with the ion exchange membrane by the counterforce of the metal elastic body.

Effects of the Invention

The elastic cushion member of the present invention allows itself to be arranged even in an ion exchange membrane electrolyzer having such a small gap between an electrode and an electrode current collecting plate that an elastic cushion member could not be conventionally arranged therein and to improve the performance in electrolysis of the ion exchange membrane electrolyzer having a small gap between an electrode and an electrode current collecting plate.

BRIEF DESCRIPTION OF THE DRAWINGS

FIG. 1 represents (a) a plan view showing one preferred embodiment of an elastic cushion member of the present invention and (b) a plan view showing one exemplary configuration of the elastic cushion member of the present invention in stretched state.

FIG. 2 represents a perspective view showing a fixed part between a metal thin plate of an elastic cushion member of the present invention and a fixing member in cases where a micromesh is used as a slippage prevention means (a) or in cases where a groove is provided as a slippage prevention means (b).

FIG. 3 represents a schematic plan view showing an example in which a hydrogen-generating cathode and a cathode current collector are electrically connected via an elastic cushion member in the cathode unit of a monopolar ion exchange membrane electrolyzer according to one preferred embodiment of the present invention.

FIG. 4 represents a schematic plan view showing an example in which a hydrogen-generating cathode and a cathode partition wall are electrically connected via an elastic cushion member in a bipolar ion exchange membrane electrolyzer unit according to another preferred embodiment of the present invention.

FIG. 5 represents (a) a perspective view showing an example of a corrosion-resistant frame used in a conventional elastic cushion member and (b) a perspective view showing an example of a conventional elastic cushion member.

MODE FOR CARRYING OUT THE INVENTION

Now, embodiments of the present invention will be described in detail with reference to the drawings.

FIG. 1 represents (a) a plan view showing one preferred embodiment of an elastic cushion member of the present invention and (b) a plan view showing one exemplary configuration of the elastic cushion member of the present invention in stretched state. The elastic cushion member (10) of the present invention comprises a pair of corrosion-resistant metal thin plates (11) (hereinafter also simply referred to as "metal thin plate") arranged at a distance in parallel fashion and fixing members (12) which fix the pair of metal thin plates (11), in which a metal elastic body (13) (a metal coil body in the illustrated example) is wound around the pair of metal thin plates (11). The fixing members (12) are attached to the pair of metal thin plates (11) by fixing devices (14) in a manner that enables detachment of the fixing members therefrom (FIG. 1*a*) and the detachment of the fixing members (12) allows the elastic cushion member (10) to change its shape freely by expansion or contraction (FIG. 1*b*).

The fixing members (12) in FIG. 1 are a pair of bars with which metal thin plates (11) are fixed at the both ends. However, embodiments of a fixing member in the elastic cushion member of the present invention are not limited to this configuration. A pair of metal thin plates (11) may be fixed by one fixing member only at the middle of each metal thin plate as long as it can fix the pair of metal thin plates (11), or multiple fixing members may be used to fix them.

A conventional elastic cushion member is prepared by winding a metal coil (22) around a corrosion-resistant frame (21) formed of a corrosion-resistant round metal bar (see FIGS. 5*a* and 5*b*), while the elastic cushion member of the present invention (10) is prepared, as shown in FIG. 1, by winding a metal elastic body (13) between a pair of metal thin plates (11) arranged at a distance in parallel fashion. The thickness of the elastic cushion member could be reduced compared to that of a conventional elastic cushion member (20) by using metal thin plates (11) thinner than a conventionally used round metal bar. This allows the elastic cushion member of the present invention (10) to be arranged even in an electrolyzer having such a small gap between an electrode and an electrode current collecting plate that a conventional elastic cushion member (20) could not be installed therein. Additionally, the thickness of a metal thin plate (11) should be appropriately set in accordance with a gap in an electrolyzer in which the metal thin plate is to be arranged. A metal or metal alloy, which exhibits good corrosion resistance, is preferred as a material of a metal thin plate (11). Nickel, a nickel alloy, or stainless steel is preferred in cases where an elastic cushion member is arranged on the cathode side, while titanium or a titanium alloy is preferred in cases where an elastic cushion member is arranged on the anode side.

FIG. 2 represents a perspective view showing a fixed part between a metal thin plate (11) of the elastic cushion member of the present invention and a fixing member (12). In the elastic cushion member of the present invention (10), a fixing member (12) is used to fix a pair of metal thin plates (11) and both the articles are fixed by a known fixing device (14). In the illustrated example, a cut-out portion is provided to an end part of a fixing member (12) and a metal thin plate (11) is inserted to the cut-out portion and fixed by a fixing device (14) (wing bolt in the illustrated example). However, the fixed part between the metal thin plate of the elastic cushion member invention and the fixing member is not limited to this configuration.

A fixing member (12) prevents deformation of an elastic cushion member (10) due to a tensile force exerted by a metal elastic body (13) and therefore is not particularly limited as long as it can resist a tensile force exerted by a metal elastic body (13). For example, a rod made of a metal, plastic or the like may be used. Additionally, the elastic cushion member of the present invention (10) may employ a fixing member having a large diameter because the elastic cushion member is used after a fixing member (12) is removed therefrom before use. Moreover, in the elastic cushion member of the present invention (10), a fixing device (14), which attaches a fixing member (12) to a metal thin plate (11), is not particularly limited and a known fixing device can be used. Examples of a fixing device can include, for example, a wing bolt as shown in the drawing.

The elastic cushion member of the present invention (10) has an effect, in which the elastic cushion member can be installed even in an ion exchange membrane electrolyzer having such a small gap between an electrode and an electrode current collecting plate that a conventional elastic cushion member cannot be arranged therein, and additionally has effects described below. The corrosion-resistant frame (21) used in the conventional elastic cushion member (20) is a rectangular frame formed of a corrosion-resistant round metal bar and the like (FIG. 5*a*) and therefore the portions of the corrosion-resistant frame except for a pair of round metal bars, around which a metal coil body (22) as a metal elastic body is wound, are unnecessary and useless after the corrosion-resistant frame is installed in an ion exchange membrane electrolyzer. On the other hand, in the elastic cushion member of the present invention (10), a fixing member (12) can be freely detached and therefore such a useless portion can be eliminated. Moreover, detachment of a fixing member (12) allows the elastic cushion member (10) to change its shape freely by expansion or contraction and therefore the elastic cushion member can be accepted by various electrolyzers different in size. Furthermore, because the elastic cushion member of the present invention (10) is used after the distance between a pair of metal thin plates (11) is expanded before use, the elastic cushion member before use is compact and it is superior in terms of storage space and transportation cost as well. Still furthermore, even in cases where a metal elastic body, which exerts a tensile force greater than that exerted by the metal coil body (22) used in the conventional elastic cushion member (20), is used, no supporting member is needed to be added in the rectangular frame, which allows such a metal elastic body to be adopted without increase in cost.

In the elastic cushion member of the present invention (10), a pair of metal thin plates (11) is preferably provided with a slippage prevention means (15) such as a micromesh (15*a*) as shown in FIG. 2*a* or a groove (15*b*) as shown in FIG. 2*b*. This is because a metal elastic body (13) wound between a pair of metal thin plates (11) easily slide and the metal elastic body (13) can be disarranged especially after a fixing member (12) is removed.

Moreover, in the elastic cushion member of the present invention (10), a metal elastic body (13) is not particularly limited as long as it is made of a conductive material and has an elastic property such that the metal elastic body can supply electric power while pressing a flexible electrode on an ion exchange membrane. However, a metal coil body is preferably used. In addition to a metal coil body, for example, a fine metal wire shaped in a wave form may be used. Moreover, a metal non-woven fabric; a knitted fabric, a woven fabric, and a layered product made of these fabrics, or a fabric knitted three-dimensionally or undulated after three dimensional knitting, which fabrics are formed of a metal wire, may be used.

In cases where a metal coil body is used as a metal elastic body (13), for example, a wire made of a metal having a low specific resistance, such as nickel, a nickel alloy, stainless steel, or copper, which exhibits good corrosion resistance, and coated with nickel or the like, which exhibits good corrosion resistance, by plating and the like can be used as a material of the metal coil body. A metal coil body can be produced by processing this wire through roll forming to a spiral coil. The cross-sectional shape of the obtained wire is preferred to be a circular shape, an oval shape, a rectangular shape with rounded corners, and the like from the viewpoint of preventing damage to an ion exchange membrane. Specifically, subjecting a nickel wire of 0.17 mm in diameter (NW2201) to roll forming can change the cross-sectional shape of the nickel wire to a rectangle of about 0.05 mm×0.5 mm with rounded corners and yield a coil wire having a winding diameter of about 6 mm.

Next, an ion exchange membrane electrolyzer of the present invention will be described in detail with reference to the drawings.

An ion exchange membrane electrolyzer of the present invention is separated by an ion exchange membrane into an anode chamber accommodating an anode and a cathode chamber accommodating a cathode, wherein the above-described elastic cushion member of the present invention (10) is arranged in at least one of the anode chamber and the cathode chamber. Examples of the ion exchange membrane electrolyzer can include, for example, a monopolar ion exchange membrane electrolyzer in which an elastic cushion member of the present invention (10) is arranged at least one of: between a cathode and a cathode current collector and between an anode and an anode current collector, and a bipolar ion exchange membrane electrolyzer in which an elastic cushion member of the present invention (10) is arranged at least one of: between a cathode and a cathode partition wall and between an anode and an anode partition wall.

FIG. 3 represents a schematic plan view showing an example in which a cathode and a cathode current collector are electrically connected via an elastic cushion member in the cathode unit of a monopolar ion exchange membrane electrolyzer according to one preferred embodiment of the present invention. In the cathode unit of a monopolar ion exchange membrane electrolyzer (100) as shown by the drawing, an elastic cushion member of the present invention (10) is arranged between a hydrogen-generating cathode (104) and a cathode current collector (103). Moreover, in the illustrated example, a pair of conductive rods (101) running vertically is provided in the electrolyzer, a cathode liquid-circulating conductive member (102) is provided around this conductive rod (101), and a cathode current collector (103) is electrically connected with this conductive member (102) on its surface.

The above-described elastic cushion member of the present invention can be suitably used in an electrolyzer having a gap between an electrode and an electrode current collecting plate as small as 1 mm or less, while an electrolyzer to which the elastic cushion member can be applied is not limited to such an electrolyzer like this. Even in an electrolyzer in which a conventional elastic cushion member can be arranged, using the elastic cushion member of the present invention can eliminate a material at the lateral part of an elastic cushion member, around which a metal elastic body is not wound, and can also reduce storage space and transportation cost compared to a conventional elastic cushion member.

In the ion exchange membrane electrolyzer of the present invention, an elastic cushion member (10) may be anchored to a cathode current collector (103) or a hydrogen-generating cathode (104) by welding and the like, though they are not always needed to be done. Examples of a procedure to fix an elastic cushion member to an existing rigid cathode and the like (a cathode in the form of an expanded metal mesh) can include, for example, a procedure using a pin and the like made of Teflon® as a fixing device, in addition to welding. Electricity is normally transmitted in a contact power distribution system. Additionally, assembly of an elastic cushion member using a metal elastic body can be easily performed because it is performed outside of an electrolyzer. The obtained elastic cushion member should be installed at the time of assembly of an electrolyzer to provide electrical connection to a current collector mounted on an electrode of interest in the electrolyzer.

In cases where a metal coil body is used as a metal elastic body in the elastic cushion member of the present invention (10), the diameter of the metal coil body (the nominal diameter of the coil) is usually reduced by 10 to 70% when it is installed in an electrolyzer. This elasticity allows an elastic connection between an anode and an anode current collector or between a cathode and a cathode current collector to be established and to facilitate power supply to the electrodes. Moreover, in cases where the diameter of a coil is fixed and a metal coil body formed of a wire having a small diameter is used, the number of contact points between an electrode and an elastic cushion member or between a current collector and an elastic cushion member is consequently increased, which enables uniform contact to be achieved. Furthermore, the shape of an elastic cushion member (10) is maintained by its pair of metal thin plates (11) after the elastic cushion member is installed in an electrolyzer, and therefore it scarcely undergoes plastic deformation and can be, in most cases, reused in reassembly after disassembly of an electrolyzer.

In the ion exchange membrane electrolyzer of the present invention, an elastic cushion member (10) or the like is arranged between at least one electrode and a current collector of the electrode and then the remaining parts of the electrolyzer are normally assembled to obtain an ion exchange membrane electrolyzer which holds the elastic cushion member (10) and the like at a predetermined position when an ion exchange membrane electrolyzer comprising an elastic cushion member (10) is assembled.

Moreover, in the ion exchange membrane electrolyzer of the present invention, an electrode catalyst may be carried on a metal elastic body of the elastic cushion member (10). That is, a metal elastic body allows itself to function as an electrode and therefore a hydrogen-generating cathode (104) in the illustrated example is not needed to be arranged, which can consequently give an advantage that the number of components can be reduced. To carry an electrode catalyst on a metal elastic body, the surface of the metal elastic body should be coated with electrode catalyst materials to form a platinum group metal-containing layer, a Raney nickel-containing layer, an activated carbon-containing layer, or the like. Examples of coating formation include, for example, nickel-dispersed plating of the surface of a metal elastic body using a Raney nickel catalyst, subjecting the surface of a metal elastic body to a plating process such as brush plating process using a noble metal or a light metal such as a hexachloroplatinate, and attaching a hexachloroplatinate on the surface of a metal elastic body by welding.

Next, a bipolar ion exchange membrane electrolyzer according to another preferred embodiment of the present invention will be described. FIG. 4 represents a schematic plan view showing an example in which a hydrogen-generating cathode and a cathode partition wall are electrically connected via an elastic cushion member in a bipolar ion exchange membrane electrolyzer unit according to another preferred embodiment of the present invention. In the illustrated bipolar ion exchange membrane electrolyzer unit (110), vertically aligned anode-holding members (113) (they are unified in the illustrated example), which locate on the anode side of an anode partition wall (111) connected with a cathode partition wall (112), are fixed by connecting belt-like junctions (114) with the anode partition wall (111) and an anode liquid-circulating passage (115) is secured inside each member (113). Moreover, cathode-holding members (116), which locate on the cathode side of the connected partition wall and correspond to the anode-holding members (113), are fixed by connecting belt-like junctions (117) with the cathode partition wall (112) and a cathode liquid circulating passage (118) is secured inside each cathode-holding member (116). A convex portion (119) is formed at the middle of the anode-holding member (113), which convex portion extends outward, and electricity is provided to an anode (120) in the form of an expanded metal mesh via this convex portion (119). The above-described elastic cushion member of the present invention (10) is in electrical contact with the flat surface of the cathode-holding member (116) and furthermore a hydrogen-generating cathode (121) is in electrical contact with the outer surface of the elastic cushion member to provide electricity from the cathode-holding member (116) to the hydrogen-generating cathode (121) via the elastic cushion member (10).

In the bipolar ion exchange membrane electrolyzer (110) according to another preferred embodiment of the present invention, an elastic cushion member, which has been provided by removing a fixing member (12) from the above-described elastic cushion member of the present invention (10), is arranged at least one of: between a hydrogen-generating cathode (121) and a cathode partition wall (112) and between an anode (120) and an anode partition wall (111), and is arranged between the hydrogen-generating cathode (121) and the cathode partition wall (112) in the illustrated example. The above-described elastic cushion member of the present invention can be suitably used in an electrolyzer having a gap between an electrode and an electrode current collecting plate as small as 1 mm or less in the bipolar ion exchange membrane electrolyzer according to another embodiment of the present invention as well as in the above described monopolar ion exchange membrane electrolyzer, while an electrolyzer to which the elastic cushion member can be applied is not limited to such an electrolyzer like this. Even in an electrolyzer in which a conventional elastic cushion member can be arranged, using the elastic cushion member of the present invention can eliminate a material at the lateral part of an elastic cushion member, around which a metal elastic body is not wound, and can also reduce storage space and transportation cost compared to a conventional elastic cushion member. Additionally, in the illustrated example, a mesh (122) is arranged in order to prevent an elastic cushion member (10) from being dropped off.

The details of the elastic cushion member according to the present embodiment are similar to those of the elastic cushion member (10) used in the above-described monopolar ion exchange membrane electrolyzer. A cathode-holding member (113) is arranged between the elastic cushion member (10) and the cathode partition wall (112) in the illustrated example, though the present invention is not limited to such a configuration and an elastic cushion member should be arranged between an electrode and a partition wall to provide electrical connection between them through this elastic cushion member.

Moreover, also in the bipolar ion exchange membrane electrolyzer according to another preferred embodiment of the present invention, an electrode catalyst may be carried on a metal elastic body of the elastic cushion member (10). That is, a metal elastic body allows itself to function as an electrode and therefore an electrode, which is a hydrogen-generating cathode (121) in the illustrated example, is not needed to be arranged, which can consequently give an advantage that the number of components can be reduced.

The ion exchange membrane electrolyzers of the present invention have been described so far by subdividing them into a case of a monopolar ion exchange membrane electrolyzer and a case of a bipolar ion exchange membrane electrolyzer. Only realizing the above-described configurations of the ion exchange membrane electrolyzers of the present invention is important and conventionally used configurations can be appropriately employed without particular limitation on the other structures of the ion exchange membrane electrolyzers.

For example, a cathode current collector may be in the form of mesh or in the form of plate and its shape is not particularly limited. Moreover, a cathode is not particularly limited as long as it is compressed by an elastic cushion member (10) so as to make contact with an ion exchange membrane and generally any cathode can be used as long as it is used for electrolysis. However, preferred is a pyrolytic activated cathode selected from a group consisting of Ru—La—Pt-based, Ru—Ce-based, Pt—Ce-based, and Pt—Ni-based cathodes, which has a thin but highly active catalytic film and does not induce mechanical damage to an ion exchange membrane due to the smooth surface of the film.

DESCRIPTION OF SYMBOLS

10 Elastic cushion member
11 Corrosion-resistant metal thin plate
12 Fixing member
13 Metal elastic body
14 Fixing device
15 Slippage prevention means
20 Elastic cushion member
21 Corrosion-resistant frame
22 Metal coil body
100 Cathode unit of a monopolar ion exchange membrane electrolyzer
101 Conductive rod
102 Conductive member
103 Cathode current collector
104 Hydrogen-generating cathode
110 Bipolar ion exchange membrane electrolyzer unit
111 Anode partition wall
112 Cathode partition wall
113 Anode-holding member
114 Belt-like junction
115 Anode liquid-circulating passage
116 Cathode-holding member
117 Belt-like junction
118 Cathode liquid circulating passage
119 Convex portion
120 Anode
121 Hydrogen-generating cathode
122 Mesh

The invention claimed is:

1. An elastic cushion member having a pair of corrosion-resistant metal thin plates arranged at a distance in parallel fashion and a fixing member which fixes the pair of corrosion-resistant metal thin plates, wherein a metal elastic body is wound between the pair of corrosion-resistant metal thin plates, and the fixing member is detachably attached to the pair of corrosion-resistant metal thin plates wherein a micromesh and/or groove is provided to the pair of the corrosion-resistant metal thin plates, and wherein the metal elastic body changes its shape freely when the fixing member is detached.

2. The elastic cushion member according to claim 1, wherein the metal elastic body is a metal coil body.

3. An ion exchange membrane electrolyzer separated by an ion exchange membrane into an anode chamber accommodating an anode and a cathode chamber accommodating a cathode, wherein an elastic cushion member is arranged in at least one of the anode chamber and the cathode chamber, characterized in that the elastic cushion member is an elastic cushion member according to claim 1.

4. The ion exchange membrane electrolyzer according to claim 3, wherein the elastic cushion member is arranged at least one of: between the cathode and a cathode current collector and between the anode and an anode current collector, wherein the electrodes are in close contact with the ion exchange membrane by the counterforce of the metal elastic body.

5. The ion exchange membrane electrolyzer according to claim 3, wherein the elastic cushion member is arranged at least one of: between the cathode and a cathode partition wall and between the anode and an anode partition wall, wherein the electrodes are in close contact with the ion exchange membrane by the counterforce of the metal elastic body.

6. The elastic cushion member according to claim 1, wherein the width of the thin plates is less than the height and length of the thin plate.

7. An elastic cushion member having a pair of corrosion-resistant metal thin plates arranged at a distance in parallel fashion and a fixing member which fixes the pair of corrosion-resistant metal thin plates, wherein a metal elastic body is wound between the pair of corrosion-resistant metal thin plates, and the fixing member is detachably attached to the pair of corrosion-resistant metal thin plates and wherein grooves are provided on one edge of the pair of the corrosion-resistant metal thin plates.

* * * * *